US012201249B2

(12) United States Patent
Baba

(10) Patent No.: US 12,201,249 B2
(45) Date of Patent: Jan. 21, 2025

(54) INCLINED CERAMIC SHOWER TILE

(71) Applicant: SERANIT GRANIT SERAMIK SANAYI VE TICARET ANONIM SIRKETI, Istanbul (TR)

(72) Inventor: Ece Ceylan Baba, Istanbul (TR)

( * ) Notice: Subject to any disclaimer, the term of this patent is extended or adjusted under 35 U.S.C. 154(b) by 0 days.

(21) Appl. No.: 16/478,975

(22) PCT Filed: Dec. 26, 2017

(86) PCT No.: PCT/TR2017/050700

§ 371 (c)(1),
(2) Date: Jul. 18, 2019

(87) PCT Pub. No.: WO2019/022685

PCT Pub. Date: Jan. 31, 2019

(65) Prior Publication Data

US 2020/0000290 A1 Jan. 2, 2020

(30) Foreign Application Priority Data

Jan. 20, 2017 (TR) ..... 2017/00918

(51) Int. Cl.
*A47K 3/40* (2006.01)

(52) U.S. Cl.
CPC ..... *A47K 3/40* (2013.01)

(58) Field of Classification Search
CPC ..... A47K 3/40
USPC ..... 4/613
See application file for complete search history.

(56) References Cited

U.S. PATENT DOCUMENTS 2,290,107 A * 7/1942 Luks ..... 501/119
2,449,323 A * 9/1948 Richterkessing ..... A47K 3/40 D23/283
5,718,008 A * 2/1998 Pane ..... A47K 3/40 210/163
6,348,425 B1 * 2/2002 Barattini ..... C03C 8/02 501/21
8,474,069 B1 * 7/2013 Whitinger ..... E03F 5/0408 4/613

(Continued)

FOREIGN PATENT DOCUMENTS

AT 11860 U1 * 4/2011 ..... A47K 3/40
CN 104513053 A * 4/2015

(Continued)

OTHER PUBLICATIONS

FR-2910261-A1 Translation (Year: 2022).*

(Continued)

*Primary Examiner* — David P Angwin
*Assistant Examiner* — William R Klotz
(74) *Attorney, Agent, or Firm* — Egbert, McDaniel & Swartz, PLLC

(57) ABSTRACT

An integrally manufactured ceramic shower tile for use on the floors of shower areas in any and all indoor/outdoor areas such as a house, hotel, pension, beach, spa, bath house, hot spring, or timeshare holiday facilities. The tile allows waste water to flow into a drainage hole without accumulating on the shower floor, and having shower tile edge height and drainage hole height of different heights, providing a slope to the shower tile.

2 Claims, 1 Drawing Sheet

(56) References Cited

U.S. PATENT DOCUMENTS

| | | | | |
|---|---|---|---|---|
| 2001/0052148 | A1* | 12/2001 | Hasenkopf | A47K 3/40<br>4/613 |
| 2003/0033668 | A1 | 2/2003 | Pane | |
| 2010/0180374 | A1 | 7/2010 | Davoudi | |
| 2014/0121301 | A1* | 5/2014 | Schibur | C04B 14/10<br>523/458 |
| 2016/0007810 | A1* | 1/2016 | Andres Alemany | B29C 45/0053<br>427/289 |
| 2016/0009601 | A1* | 1/2016 | Han | C04B 33/30<br>501/141 |
| 2016/0174773 | A1* | 6/2016 | Summers | E03F 5/0408<br>4/613 |

FOREIGN PATENT DOCUMENTS

| | | | | |
|---|---|---|---|---|
| DE | 19725963 | A1 * | 12/1998 | A47K 3/008 |
| EP | 2343000 | A1 * | 7/2011 | A47K 3/40 |
| FR | 2910261 | A1 * | 6/2008 | A47K 3/40 |
| PL | 157787 | B1 * | 7/1992 | |

OTHER PUBLICATIONS

CN-104513053-A Translation (Year: 2022).*
PL-157787-B1 Translation (Year: 2022).*
AT-11860-U1 Translation (Year: 2022).*
DE-19725963-A1 Translation (Year: 2022).*
International Search Report as to PCT/TR2017/050700.

* cited by examiner

INCLINED CERAMIC SHOWER TILE

THE RELATED ART

The invention relates to a shower floor used in bathroom shower area, shower cabin, all areas where shower may be taken.

The invention particularly relates to an integrally manufactured self-inclined ceramic shower tile which is used in shower areas in any and all indoor/outdoor areas such as house, hotel, pension, beach, spa, bath house, hot spring, timeshare holiday facilities, and letting waste water to flow into drainage hole without accumulating.

THE PRIOR ART

Today while shower cabins or bathtubs which are generally made from acrylic materials, are generally used in shower-bath areas at houses, hotels etc., those made from mosaic, ceramic, marble etc. are used in areas such as spa, bath, sauna etc. In addition to them, in recent years, ceramic/porcelain tiles are often used in shower areas, take the top ranks among the preferred materials.

However, various problems are experienced in use of said product in the prior art. The porcelain tile covering shower floor, is constantly manufactured, must have a certain thickness at all areas according to ISO 10545-2 standard. Thus, the manufactured porcelain tiles do not have inclination. Therefore, particularly when covering shower floor, tiles should be laid part by part in order to ensure easy flow of water into drainage. Meanwhile, each tile is given a slope in the direction of flowing with the help of the mortar filling under the tiles. In case they are not laid properly, water accumulates in the gaps between tiles and certain parts of the tile surfaces, develops odor in time and also causes water stain.

Also, in order to prevent feet of the user from slipping and accident risk, during the shower, the ceramic/porcelain tiles which are presently used in wet volumes, are manufactured with a jagged surface, at the level not causing any disturbance to the user. This jagged surface generally occurs on ceramic/porcelain tiles which are not self-inclined.

Each porcelain tile meets the deformation values according to tolerances specified under ISO 10545-2 deformation criteria standards. For that reason, in its use in shower areas, water accumulation is inevitable due to deformation even if inclination is provided by the mortar under it.

The developments made in the related and the development mentioned above have remained insufficient for solving said problems. Said case has necessitated development in the prior art.

PURPOSE OF THE INVENTION

The invention is a shower tile meeting the needs mentioned above, eliminating all disadvantages and providing some additional advantage and used for the floor of shower facilities in any and all indoor/outdoor areas.

Purpose of the invention is to provide a self-inclined shower tile directing water into drainage without accumulating.

Purpose of the invention is to stop the development of undesired situations such as odor and stains by preventing accumulation of water by providing water channels on tile surface.

Purpose of the invention is to provide easy to assemble as it is integrally manufactured and thus reduce error rate, ensure considerably high hygiene level without need for combining materials and reduce labor costs.

Purpose of the invention is to obtain a shower tile providing resistance against chemicals and extend the life span of the product via glaze applied on the surface. It also aims to provide a non-slippery surface and to prevent deformation such as scratching, abrasion via the glaze.

purpose of the invention is to manufacture said shower tile in TS EN 14411 (ISO 13006) low water absorbing dry pressed ceramic tile standard, Annex G group Bla ($Eb \leq 0.5\%$) or Annex H group Blb ($0.5\% < Eb \leq 3\%$) class.

Purpose of the invention is to provide flexibility in usage area and architectural size due to the capability of it to be manufactured in various sizes.

Purpose of the invention is to provide aesthetic appearance and ease of use of features.

Purpose of the invention is to provide ease of use in cleaning made with home and pool chemicals due to it is being a self-inclined tile.

The structural and characteristics features of the invention and all advantages will be understood better in detailed descriptions with the figures given below and with reference to the figures, and therefore, the assessment should be made taking into account said figures and detailed explanations.

REFERENCE NUMBERS

1. Shower tile
H1. Tile height
2. Drainage hole
H2. Drainage hole height
3. Water channel

DETAILED DESCRIPTION OF THE INVENTION

In this detailed description, the preferred embodiments of the shower tile (1) subject of the invention, have been described in a manner to not form any restrictive effect and only for purpose of better understanding of the matter.

Figure 1:
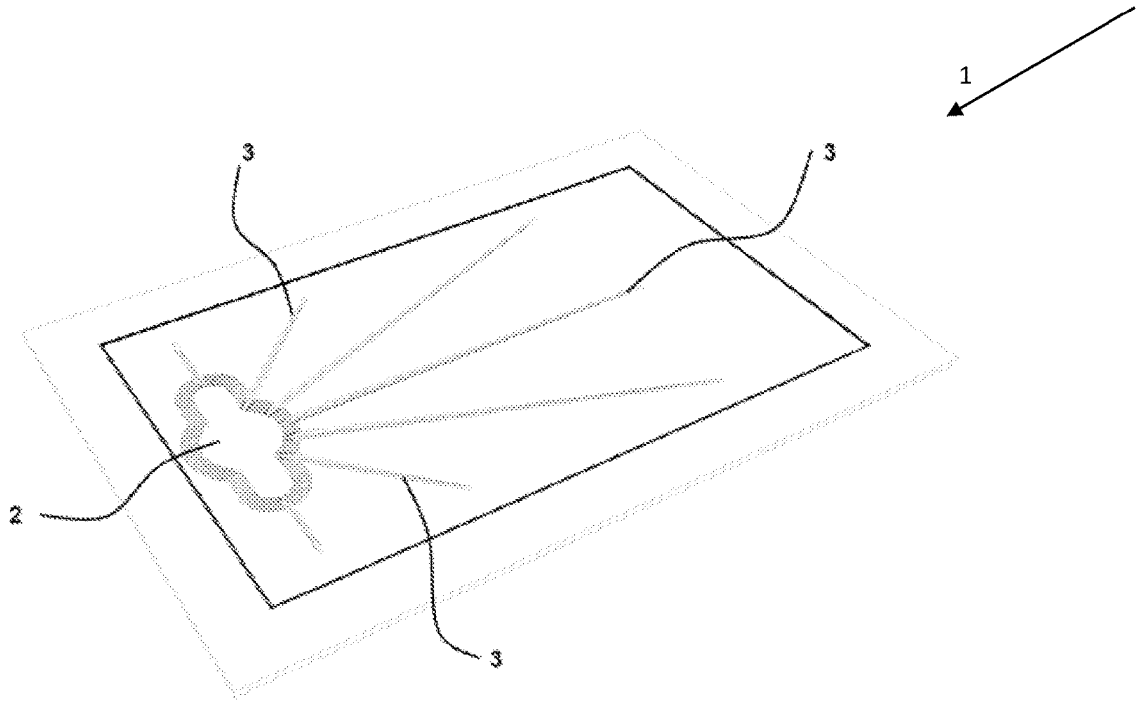
FIG. 1 is general view of the shower tile subject of the invention.

The invention is an integrally manufactured self-inclined ceramic shower tile (1) which is used in shower areas in any and all indoor/outdoor areas such as house, hotel, pension, beach, spa, bath house, hot spring, timeshare holiday facilities, and letting waste water to flow into the drainage hole (2) without accumulating. In FIG. 1, general view of the shower tile (1) subject of the invention, is given.

Figure 2:
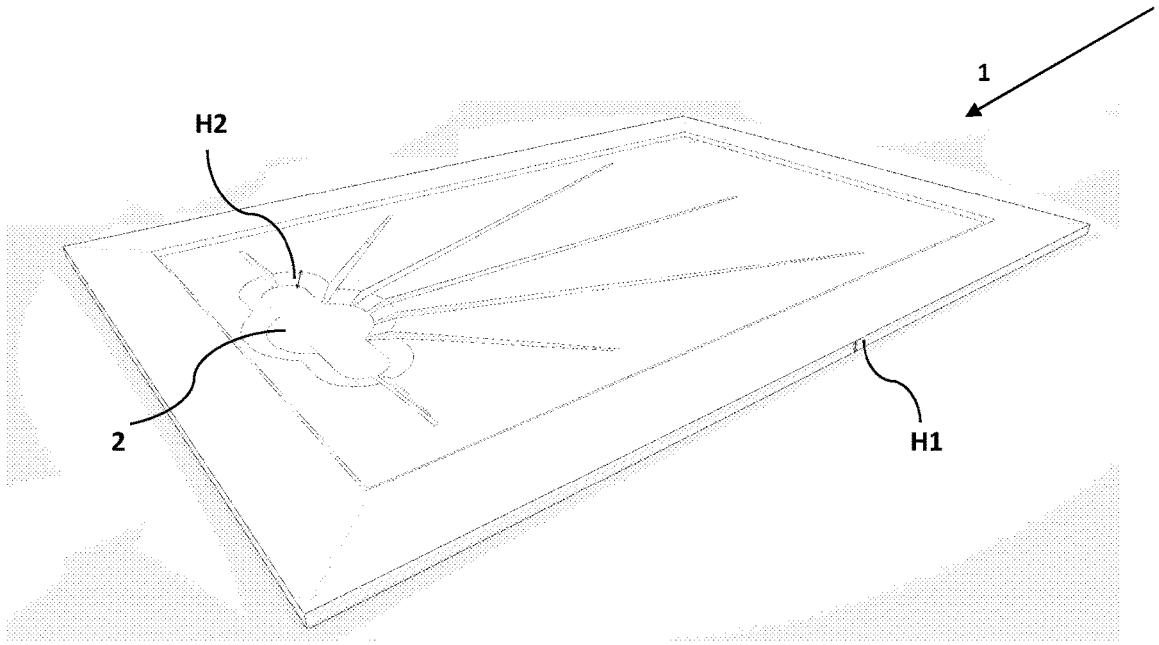
FIG. 2 is general view of the shower tile subject of the invention, with height values.

The inclined ceramic shower tile (1) disclosed under this invention, comprising a drainage hole (2) preventing water accumulation by letting water to flow in sewage system drainage, and more than one water channels (3) letting water to flow into said drainage hole (2) faster. In FIG. 2, the drainage hole height (H2) illustrating the height of said drainage hole (2), and shower tile edge height (H1) illustrating the height of shower tile edge (1), are given. The shower tile (1) disclosed under this invention naturally gains slope due to the difference between the drainage hole height (H2) and shower tile edge height (H1). Said shower tile (1) is manufactured integrally via dry press method.

Shower tile edge height (H1) is faced to outer frame set part of the ceramic shower tile (1) and height of it is preferably manufactured in 14±0.5 mm. Thickness reduces towards the drainage hole (2) and thus slope (natural flow) is provided. The drainage hole height (H2) is preferably manufactured in 10.3±0.7 mm. Thus a slope is formed in the shower tile (1) due to height difference and the shower water flows into the drainage hole (2) without accumulating. The most important characteristic of the shower tile (1) subject of the invention, is that the tile edge height (H1) is bigger than the drainage height (H2) and thus natural flow is provided on the shower tile (1).

Also the water channels (3) shown in FIG. 1 and FIG. 2, as a support to the slope, provides faster flow of the water into the drainage hole (2) through these channels. The glaze materials coated onto the ceramic shower tile (1) prevents the user who is taking a shower, from slipping and provides him/her to have a comfortable and safe shower. Said glaze material having a high melting point, comprises alumina, corundum, magnesite, zinc oxide, calcium in various particle sizes. Said shower tile (1) has high strength as it is integrally manufactured, and is a highly hygienic product since it does not need binding materials such as mortar.

During product process, deformation would occur due to compression difference of product in different thicknesses therefore bottom mold is designed accordingly. It is shaped in isostatic form under 310 bars pressure per $cm^2$. Architectural size flexibility is provided due to size flexibility as slope is from 80×80 cm to 90×135 cm. Said shower tile (1) is made from high form ceramic materials manufactured from clay, kaolin, feldspar raw materials. Water absorption (Eb) is lower than 0.5% pursuant to TS EN 14411 standard, of Annex G Bla class or 0.5%<Eb≤3% range in Annex H group Blb.

Therefore, shower tile edge height (H1) provides set in the product, letting water to flow through the slope descending to the drainage hole (2) without occurrence of undesired conditions such as water accumulation, odor and water stain capable, and an easy and error-free installation and easy to clean structure due to it being integrally made.

Ceramic materials are classified into various classes based on production methods and technical characteristics of end product pursuant to TS EN 14411. The inclined ceramic shower tile (1) subject of this invention, is a dry pressed ceramic/porcelain tile. When water absorption value (Eb) is less than 0.5% and in addition meets other criteria such as strength and durability, it is classified under Annex G group Bla and falls within said class. It is classified as Annex H group Blb as water absorption value (Eb) is in range of 0.5% to 3% and also meets other criteria such as strength and durability. The shower tile (1) subject of the invention may meet requirements of both said classes.

The invention claimed is:

1. An article for use in shower areas, the article comprising:

a dry press ceramic tile having a monolithic structure and having an edge height and a drainage hole height, the edge height being greater than the drainage hole height so as to allow water to flow toward a drainage hole at the drainage hole height without accumulating on said dry press ceramic tile, wherein a thickness of said dry press ceramic tile reduces continuously from the edge height toward the drainage hole height such that a continuous slope is formed between the edge height and the drainage hole height, wherein said dry press ceramic tile is formed of clay, kaolin, or feldspar raw materials, said dry press ceramic tile having a water absorption value less than 0.5%, wherein said dry press ceramic tile has a plurality of water channels formed on a surface thereof, the plurality of water channels adapted to facilitate water flow along the slope and toward the drainage hole, the plurality of water channels radiating away from the drainage hole such that one end of each of the plurality of water channels terminates at the drainage hole.

2. The article of claim 1, further comprising:

a glaze material covering the surface of said dry press ceramic tile, said glaze material comprises alumina, corundum, magnesite, zinc oxide and calcium.

* * * * *